United States Patent [19]

Yagisawa

[11] 4,427,367

[45] Jan. 24, 1984

[54] SPRAY TYPE COMBUSTION DEVICE

[75] Inventor: Kenzi Yagisawa, Yokohama, Japan

[73] Assignee: Nissan Motor Co., Ltd., Yokohama, Japan

[21] Appl. No.: 261,373

[22] Filed: May 7, 1981

[30] Foreign Application Priority Data

May 9, 1980 [JP] Japan ..... 55-60683

[51] Int. Cl.[3] ..... F23D 13/40

[52] U.S. Cl. ..... 431/354; 431/182; 431/187; 431/265; 431/353; 239/113; 239/424

[58] Field of Search ..... 431/116, 182, 183, 185, 431/187, 264, 265, 353, 354; 239/104, 112, 113, 419.3, 424, 432

[56] References Cited

U.S. PATENT DOCUMENTS

| | | | |
|---|---|---|---|
| 3,570,242 | 3/1971 | Leonardi et al. | 431/354 X |
| 3,748,111 | 7/1973 | Klose | 431/346 |
| 3,852,022 | 12/1974 | Medeot et al. | 431/265 X |
| 4,004,875 | 1/1977 | Zink et al. | 431/187 X |
| 4,115,050 | 9/1978 | Gerwin | 431/265 X |
| 4,162,888 | 7/1979 | Weishaupt et al. | 431/265 |

FOREIGN PATENT DOCUMENTS 7405408 7/1974 Fed. Rep. of Germany .

*Primary Examiner*—Samuel Scott
*Assistant Examiner*—Margaret A. Focarino
*Attorney, Agent, or Firm*—Schwartz, Jeffery, Schwaab, Mack, Blumenthal & Koch

[57] ABSTRACT

A spray type combustion device comprises a fuel injection nozzle disposed inside an inner cylinder which is surrounded with an outer cylinder to form therebetween an annular air space, the inner cylinder being formed with an air introduction opening through which air is introduced to the inside of the inner cylinder, and a restrictor plate formed with a central opening and positioned to be close to the tip of the fuel injection nozzle so as to form therebetween a clearance for restricting air flow therethrough, thereby preventing the nozzle opening of the fuel injection nozzle from being clogged with carbon particles due to fuel incomplete combustion.

11 Claims, 6 Drawing Figures

SPRAY TYPE COMBUSTION DEVICE

BACKGROUND OF THE INVENTION

This invention relates to a spray type combustion device for combusting a liquid fuel such as kerosene, light oil, gasoline which device is usable in a passenger compartment heating device of vehicles etc.

In connection with liquid fuel combustion devices, spray type combustion devices are known in which a liquid fuel such as kerosene, light oil or gasoline is injected through a fuel injection nozzle to be sprayed into a combustion chamber. The thus atomized liquid fuel is mixed with air in the combustion chamber and then combusted therein to generate heat for heating the inside of a passenger compartment of a vehicle.

BRIEF SUMMARY OF THE INVENTION

In accordance with the present invention, a spray type combustion device comprises a fuel injection nozzle which is securely disposed inside an inner cylinder which is surrounded with an outer cylinder to form therebetween an annular space to be supplied with air. The combustion device further comprises a restrictor plate secured to an end of the inner cylinder and formed at its central section with an opening through which fuel injected from the fuel injection nozzle is supplied to a combustion chamber supplied with air from the annular space. The restrictor plate is so positioned that the tip section of the fuel injection nozzle is close thereto to form therebetween a restriction clearance for restricting the flow of air to be supplied through the restrictor plate opening into the combustion chamber, which air has been introduced to the inside of the inner cylinder through an air introduction opening formed through the inner cylinder.

With this arrangement, air flow is always generated near the nozzle opening formed at the tip section of the fuel injection nozzle, and therefore carbon particles due to incomplete combustion of the fuel cannot stay near the nozzle opening. As a result, the nozzle opening of the fuel injection nozzle can be prevented from being clogged or narrowed with the accumulated carbon particles, thereby maintaining normal fuel injection to the combustion chamber.

BRIEF DESCRIPTION OF THE DRAWINGS

The features and advantages of the spray type combustion device according to the present invention will be more clearly appreciated from the following description taken in conjunction with the accompanying drawings in which like reference numerals designate like parts and elements, and in which.

DETAILED DESCRIPTION OF THE INVENTION

Figure 1:
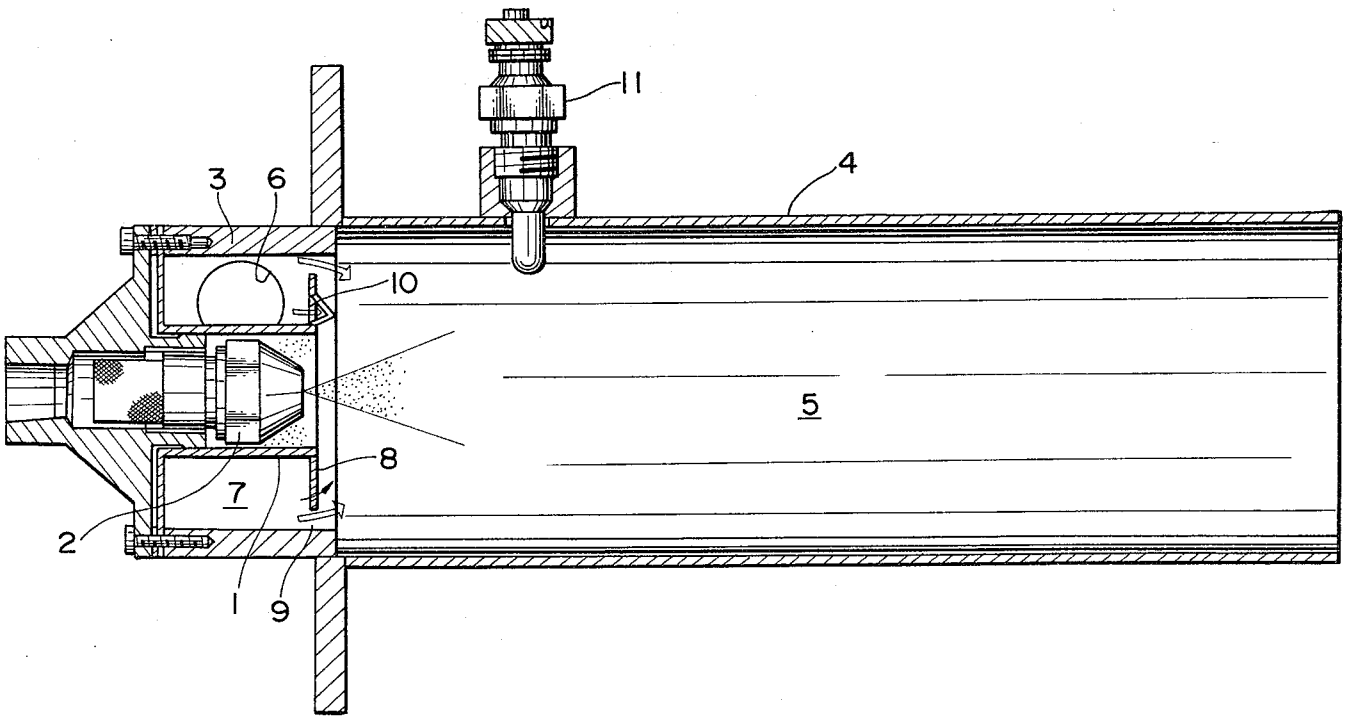
FIG. 1 PRIOR ART
FIG. 1 is a vertical sectional view of a conventional spray type combustion device.

To facilitate understanding to present invention, a brief reference will be made to a conventional spray type combustion device, depicted in FIG. 1. Referring to FIG. 1, the combustion device has a fuel injection nozzle 2 which is installed within an inner cylinder 1. Liquid fuel is injected from the fuel injection nozzle 2 into a combustion chamber 5 formed within a combustion cylinder 4 which is securely connected to an outer cylinder, so as to supply the combustion chamber 5 with atomized fuel. Otherwise, air for combustion is supplied through an air introduction tube 6 into an annular chamber 7 which is formed between the inner and outer cylinders 1, 3. This air rotates around the inner cylinder 1 and then introduced into the combustion chamber 5, in which a part of the air passes through a clearance between the outer cylinder 3 and the outer periphery of a flange-like baffle plate 8 which is positioned at the free end of the inner cylinder 7, and the remaining part of the air passes through a plurality (about eight) of openings 10 formed through the baffle plate 8. Each opening 10 is formed by forming an L-shaped cutting line on the baffle plate 8 and then bending the section defined by the cutting line, and therefore a louver or vane for guiding air is formed ajacent each opening 10. The louver forms a predetermined angle relative to the surface of the baffle plate 8 so that the air passing through the opening 10 flows in a spiral manner into the combustion chamber 5.

The air and the above-mentioned atomized fuel are mixed together within the combustion chamber 5. The first ignition to the mixture of air and fuel is accomplished upon glow of an ignitor 11, which is achieved by passing electric current through the plug 11. Thereafter, the ignition of the air-fuel mixture successively takes place to achieve a continuous combustion within the combustion chamber 5 to form hot burnt gas. The thus formed burnt gas is introduced to a heat exchanger (not shown) disposed to be subjected thereto, in which heat exchange is carried out between the burnt gas and air for heating the inside of a passenger compartment.

However, such a conventional spray type combustion device has encountered the problems in which the air-fuel mixture tends to stay adjacent the tip section of the fuel injection nozzle 2, i.e. at the space between the fuel injection nozzle tip section and the inner surface of the inner cylinder 1. Incomplete combustion of the such air-fuel mixture takes place to form carbon particles, and then the carbon particles accumulate on the tip section of the fuel injection nozzle. The thus accumulated carbon particles reduces the cross-sectional area of or clogs the nozzle opening of the fuel injection nozzle 2. This results in an annual angle of the spray cone of the injected fuel from the fuel injection nozzle 2, and also results in difficulty in controlling combustion within the combustion chamber 5.

In view of the above description of the conventional spray type combustion device, reference is now made to FIGS. 2 to 6, wherein an embodiment of a spray type combustion device of the present invention is illustrated by numeral 20. The combustion device 20 is usable in a system for heating air inside the passenger compartment of an automotive vehicle though not shown. The combustion device 20 comprises a fuel injection nozzle 22 which is securely carried by a base member 24 which is formed with a fuel inlet 26 through which fuel under pressure is supplied to the fuel injection nozzle 22. An inner cylinder 28 is disposed around the fuel injection nozzle 22 forming a space therebetween, and formed with a flange section 28*a* which is securely connected to the base member 24. An outer cylinder 30 is securely disposed around the inner cylinder 28 forming therebetween an annular space 32 to which air for assisting combustion is supplied through an air introduction pipe 34. The air introduction pipe 34 is tangentially arranged relative to the annular space 32 so that the air from the introduction pipe 34 rotates around along the outer surface of the inner cylinder 28.

The inner cylinder 28 is formed with an air introduction opening 36 which is positioned at the location against which air from the introduction pipe 34 strikes. It will be understood that a part of air from the introduction pipe 34 is introduced into the inside of the inner cylinder 28 to reach a space 37 formed between a frustoconical tip section 22*a* of the fuel injection nozzle 22 and the inner surface of the inner cylinder 28. It is to be noted that the inner cylinder 28 is formed with a guide vane 38 (FIG. 3) for effectively guiding air from the introduction pipe 34 toward the inside of the inner cylinder 28. A circular plate member 40 is secured to an end of the inner cylinder 28 and located to be close to the flat end face F of the fuel injection nozzle tip 22*a*. The circular plate member 40 extends radially and outwardly so that its periphery is located near the inner surface of the outer cylinder 30 to form an annular clearance 42 therebetween. It will be understood that the circular plate member 40 includes an annular baffle plate section 40B located outward relative to the inner cylinder 28 so as to regulate the flow direction of the air from the annular space 32 to the combustion chamber 44, and a circular restrictor plate section 40R located inward relative to the inner cylinder 28 so as to form a restriction clearance 48 between it and the tip section 22*a* of the fuel injection nozzle 22, the restriction clearance serving as a throat section for restricting air flow therethrough. The annular baffle plate section 40B is formed with a plurality of air discharge openings 43 each of which is provided with a guide louver or vane 43A. The plate member 40 is further formed at its central section with a central opening 40*a* through which fuel injected from a nozzle opening 22*b* is supplied to a combustion chamber 44 formed within a combustion cylinder 46 securely connected to the outer cylinder 30. It is to be noted that the circular plate member and the fuel injection nozzle 22 are so positioned that the narrow restriction clearance 48 is formed between the periphery of the opening 40*a* of the restrictor plate section 40R and the flat end face F of the fructoconical tip section of the fuel injection nozzle 22. The reference numeral 50 designates an igniter for igniting air-fuel mixture formed in the combustion chamber 44.

With the thus arranged combustion device 20, air is supplied tangentially through the air introduction pipe 34 to the annular space 32, and then a part of the air is introduced through the opening 36 into the inside of the inner cylinder 28 to reach the space 37 formed around the fuel injection nozzle tip section 22*a*. The remaining part of the air in the annular space 32 is supplied through the clearance 42 and the air discharge openings 43 into the combustion chamber 44. The air in the space 37 flows to the restriction clearance 48 between the periphery of the opening 40*a* of the plate member 40 and the flat end face F of the fuel injection nozzle tip section 22*a*, and is then discharged through the plate member opening 40*a* to the combustion chamber 44. Accordingly, fuel particles sprayed from the fuel injection nozzle 22 do not stay in the vicinity of the surface of the fuel injection nozzle tip section 22*a*, and therefore the flat end face F and the outer surface of the fuel injection nozzle tip section 22*a* can be prevented from carbon particles attaching thereto and accumulating thereon. The sprayed fuel from the fuel injection nozzle 22 is combined with the air supplied mainly through the annular clearance 42 and mixed by air from the air discharge openings 43 to form an air-fuel mixture within the combustion chamber 44. The thus formed air-fuel mixture is ignited by the igniter 50 to make a continuous and successive combustion of air-fuel mixture. It will be appreciated that the combustion device may be provided with a heat exchanger for transmit the heat generated within the combustion chamber 44 to the inside of a passenger compartment of the automotive vehicle.

Figure 2:
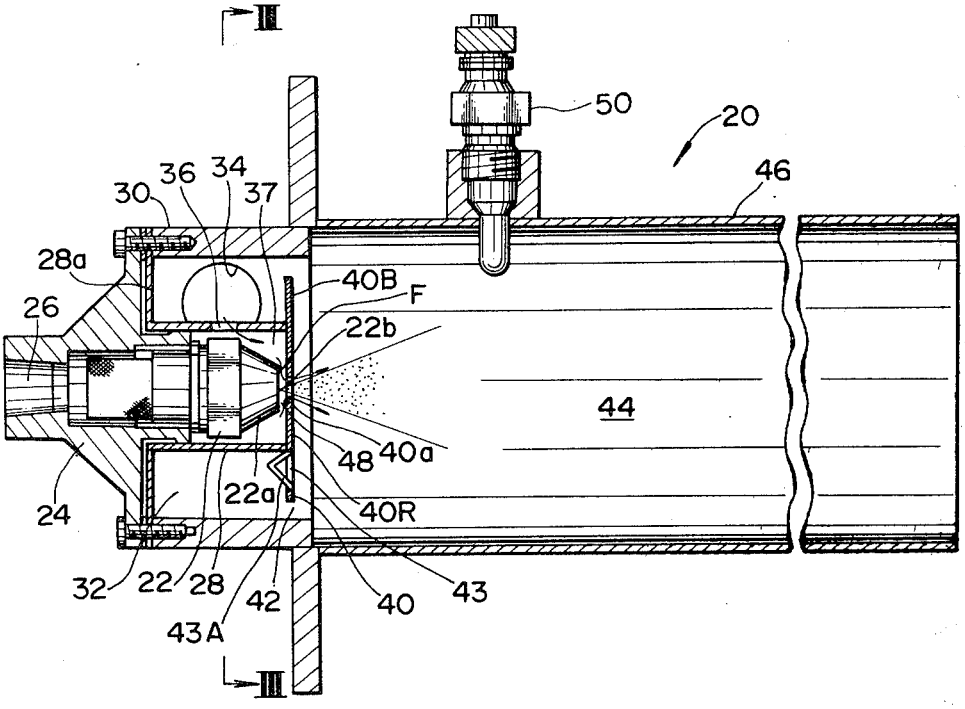
FIG. 2 is a vertical sectional view of an embodiment of a spray type combustion device in accordance with the present invention.
Figure 3:
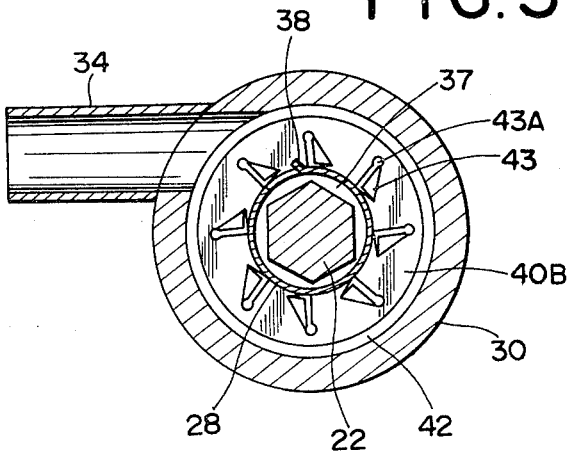
FIG. 3 is a cross-sectional view taken in the direction of arrows substantially along the line III—III of FIG. 2.
Figure 4:
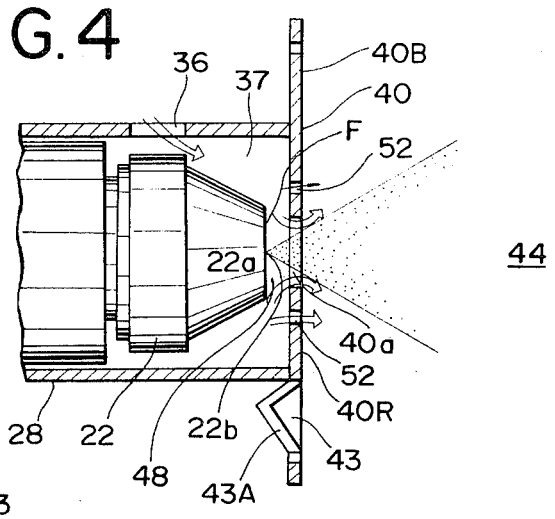
FIG. 4 is an enlarged sectional view of an essential part of a modified example of the combustion device of FIGS. 2 and 3.

FIG. 4 shows a modified example of the embodiment shown in FIGS. 2 and 3. In this example, the circular plate member 40 is formed with a plurality of through-holes 52 which are located around the central opening 40*a* at equal intervals. By virtue of the thus formed through-holes 52, a part of air introduced through the opening 36 to the space 37 flows out through the through-holes 52, thereby generating air flow near the annular plate member 40 at the combustion chamber (44) side. This prevents fuel particles from staying there and accordingly prevents carbon particles from accumulating on the plate member surface at the combustion chamber side. As a result, the sprayed fuel from the fuel injection nozzle 22 is prevented from striking against carbon particles accumulated on the plate member surface in the vicinity of the central opening 40*a*. It will be understood that this arrangement can effectively prevent combustion deterioration due to accumulated carbon in the vicinity of the central opening 40*a* of the plate member 40.

Figure 5:
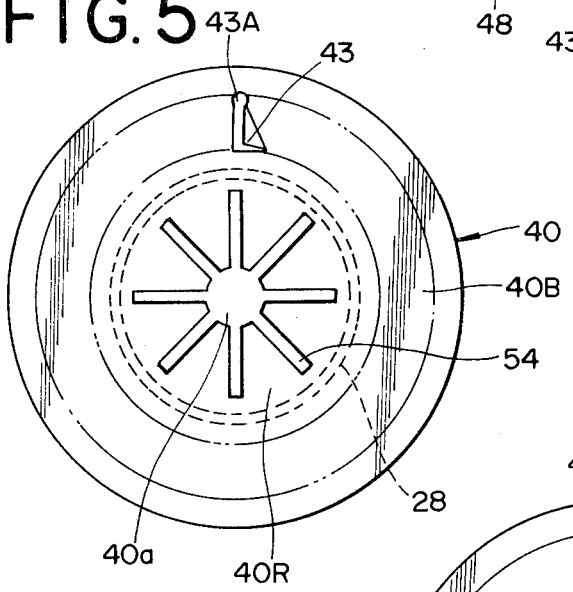
FIG. 5 is a front view of an annular plate member of FIG. 4.

FIG. 5 illustrates another modified example of the embodiment shown in FIGS. 2 and 3, in which the circular plate member 40 is formed at its restrictor plate section 40R with a plurality of slits 54 which radially and outwardly extend from the central opening 40*a*. It will be also understood that the thus formed slits 54 can offer the same advantage as in the example of FIG. 4.

Figure 6:
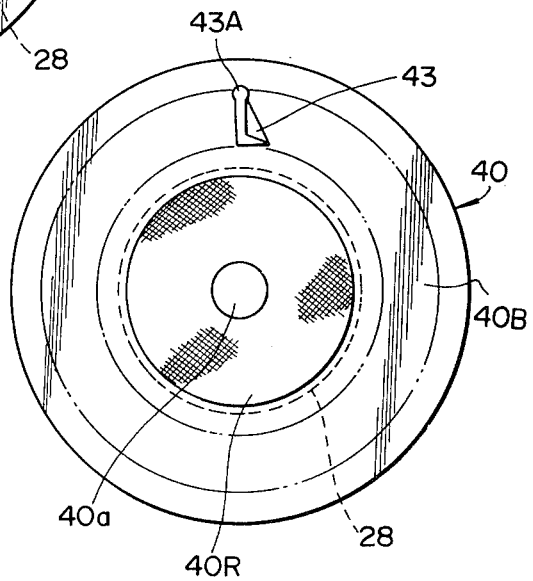
FIG. 6 is a front view similar to FIG. 5, but showing another modified example of combustion device of FIGS. 2 and 3.

FIG. 6 illustrates a further modified example of the combustion device 20 shown in FIGS. 2 and 3. In this example, the restrictor plate section 40R is formed of a wire netting or may be formed of a perforated plate. It will be understood that the same advantage as in the example of FIG. 4 can be obtained in this embodiment.

As appreciated from the foregoing, according to the present invention, the injected fuel particles do not stay near the fuel injection nozzle tip section, thereby preventing carbon particle accumulation on the fuel injection nozzle tip section. This effectively prevents the nozzle opening of the fuel injection nozzle from clogging with the carbon particles, and additionally prevents the angle of fuel spray cone from becoming unusal.

What is claimed is:

1. A combustion device comprising:

an outer cylinder;

an inner cylinder disposed within said outer cylinder to form an annular space between it and said outer cylinder, said annular space being supplied with air, said inner cylinder being formed with an air introduction opening through which the air within said annular space is introduced into a space defined inside said inner cylinder;

a baffle plate secured to an end of said inner cylinder and extending radially outwardly toward said outer cylinder, forming a clearance between the periphery thereof and said outer cylinder;

a restrictor plate secured to the end of said inner cylinder in a manner to close the opening of the inner cylinder end, said restrictor plate being formed with a central opening and a plurality of openings through which air within said inner cylinder flows out;

a combustion cylinder connected to said outer cylinder and forming thereinside a combustion chamber adjacent said baffle plate and restrictor plate, said combustion chamber communicating through said clearance with said annular space and through said openings with said space defined inside said inner cylinder; and a fuel injection nozzle securely disposed inside said inner cylinder and so located that its tip section is close to said restrictor plate to define a restriction clearance between it and the periphery of said central opening to restrict air flow therethrough, said fuel injection nozzle being formed at its tip section with a nozzle opening through which fuel is injected to be supplied through said central opening into said combustion chamber.

2. A combustion device as claimed in claim 1, wherein said openings are slits which are radially and outwardly extend from said central opening of said restrictor plate.

3. A combustion device as claimed in claim 1, wherein said restrictor plate is a wire netting.

4. A combustion device as claimed in claim 1, wherein said air introduction opening of said inner cylinder is located at a position against which the air supplied to said annular space strikes.

5. A combustion device as claimed in claim 1, wherein said fuel injection nozzle tip section is formed into the frustoconical shape to form a flat end face which is parallel with the flat surface of said restrictor plate to define therebetween said restriction clearance, said flat end face being formed with said nozzle opening.

6. A combustion device as claimed in claim 1, further comprising an air introduction pipe which is so connected to said outer cylinder that its axis is tangential relative to said annular space.

7. A combustion device as claimed in claim 1, wherein said fuel injection nozzle is located coaxial with said inner cylinder, said outer cylinder and said combustion cylinder.

8. A combustion device as claimed in claim 1, wherein said baffle plate and said restrictor plate are perpendicular to the axis of said fuel injection nozzle.

9. A combustion device as claimed in claim 1, wherein said baffle plate and said restrictor plate are integral with each other to form a flat single plate.

10. A combustion device as claimed in claim 4, wherein said inner cylinder is formed with an air guide member for guiding air supplied to said annular space through said air introduction opening into the inside of said inner cylinder.

11. A combustion device comprising:

an outer cylinder;

an inner cylinder disposed within said outer cylinder to form an annular space between it and said outer cylinder, said annular space being supplied with air, said inner cylinder being formed with an air introduction opening through which the air within said annular space is introduced into a space defined inside said inner cylinder;

a baffle plate secured to an end of said inner cylinder and radially outwardly extending toward said outer cylinder, forming a clearance between the periphery thereof and said outer cylinder;

a restrictor plate secured to the end of said inner cylinder in a manner to close the opening of the inner cylinder end, said restrictor plate being formed at its central section with a central opening and a plurality of openings through which air within said inner cylinder flows out, said plurality of openings being through-holes and located around said central opening;

a combustion cylinder connected to said outer cylinder and forming thereinside a combustion chamber adjacent said baffle plate and restrictor plate, said combustion chamber communicating through said clearance with said annular space and through said openings with said space defined inside said inner cylinder; and a fuel injection nozzle securely disposed inside said inner cylinder and so located that its tip section is close to said restrictor plate to define a restriction clearance between it and the periphery of said central opening to restrict air flow therethrough, said fuel injection nozzle being formed at its tip section with a nozzle opening through which fuel is injected to be supplied through said central opening into said combustion chamber.

* * * * *